US008426760B2

(12) United States Patent
Holaus et al.

(10) Patent No.: US 8,426,760 B2
(45) Date of Patent: Apr. 23, 2013

(54) HIGH-VOLTAGE CIRCUIT BREAKER HAVING A SWITCH FOR CONNECTION OF A CLOSING RESISTOR

(75) Inventors: Walter Holaus, Zurich (CH); Diego Sologuren-Sanchez, Wettingen (CH); Thomas-Juerg Willi, Zurich (CH); Urs Kruesi, Wiesendangen (CH); Sami Kotilainen, Niederrohrdorf (CH); Martin Holstein, Malmö (SE); Anupam Arya, Vadodara (IN); Kalpesh Chauhan, Gujarat (IN); Miguel Garcia, Duebendorf (CH); Markus Keller, Zurich (CH)

(73) Assignee: ABB Technology AG, Zurich (CH)

( * ) Notice: Subject to any disclaimer, the term of this patent is extended or adjusted under 35 U.S.C. 154(b) by 282 days.

(21) Appl. No.: 12/720,439

(22) Filed: Mar. 9, 2010

(65) Prior Publication Data

US 2010/0219163 A1 Sep. 2, 2010

Related U.S. Application Data

(63) Continuation of application No. PCT/EP2008/061745, filed on Sep. 5, 2008.

(30) Foreign Application Priority Data

Sep. 10, 2007 (EP) ..... 07116040

(51) Int. Cl.
*H01H 33/02* (2006.01)

(52) U.S. Cl.
USPC ..... 218/143; 218/7; 218/78

(58) Field of Classification Search ..... 218/2–7, 218/12–14, 78, 143; 361/1–14
See application file for complete search history.

(56) References Cited

U.S. PATENT DOCUMENTS 2,117,975 A 5/1938 Moore
2,996,592 A 8/1961 Heberlein et al.
(Continued)

FOREIGN PATENT DOCUMENTS

CH 425 943 A 12/1966
CH 660 645 A5 5/1987
(Continued)

OTHER PUBLICATIONS

International Search Report of PCT/EP2008/061745 dated Feb. 12, 2009.

(Continued)

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

A high-voltage circuit breaker has an interrupter unit, a closing resistor and a switch which is connected in series with the closing resistor. The interrupter unit has a driven first interrupter contact which can move along an axis and interacts with a second interrupter contact, which is arranged on the axis in order to open and close the high-voltage circuit breaker. The switch has a switching contact which can rotate about a rotation shaft (D) and whose rotary movement is coupled by of a link control to the movement along the axis (A1) of the first interrupter contact.

26 Claims, 7 Drawing Sheets

U.S. PATENT DOCUMENTS

| | | | | |
|---|---|---|---|---|
| 3,291,947 | A | 12/1966 | Van Sickle | |
| 3,538,276 | A | 11/1970 | Leeds | |
| 4,009,458 | A * | 2/1977 | Kishi et al. | 218/65 |
| 4,095,069 | A | 6/1978 | Yeckley et al. | |
| 4,263,491 | A * | 4/1981 | Murashita et al. | 218/8 |
| 4,443,674 | A | 4/1984 | Calvino | |
| 4,499,350 | A | 2/1985 | Hidaka | |
| 4,510,359 | A * | 4/1985 | de Calvino y Teijeiro | 218/143 |
| 6,072,673 | A * | 6/2000 | Chen et al. | 361/9 |
| 2009/0067108 | A1 | 3/2009 | Kruesi et al. | |

FOREIGN PATENT DOCUMENTS

| | | | |
|---|---|---|---|
| CN | 1901124 | A | 1/2007 |
| CN | 1959892 | A | 5/2007 |
| DE | 1 590 985 | A1 | 6/1970 |
| GB | 2 117 975 | A | 10/1983 |

OTHER PUBLICATIONS

Non-English version of the Written Opinion of the International Searching Authority of PCT/EP2008/061745 dated Feb. 12, 2009.

European Search Report of EP 07116040.2 dated Feb. 18, 2008.

Notification of Transmittal of Translation of the International Preliminary Report on Patentability (Forms PCT/IB/338 and PCT/IB/373) and the Written Opinion of the International Searching Authority (Forms PCT/ISA/237) issued in corresponding International Application No. PCT/EP2008/061745 dated Apr. 15, 2010.

Office Action from the State intellectual property Office, P.R. China dated Jul. 13, 2012, issued in corresponding Chinese Patent Application No. 200880115109.2, with English translation thereof.

* cited by examiner

HIGH-VOLTAGE CIRCUIT BREAKER HAVING A SWITCH FOR CONNECTION OF A CLOSING RESISTOR

RELATED APPLICATIONS

This application claims priority as a continuation application under 35 U.S.C. §120 to PCT/EP 2008/061745, which was filed as an International Application on Sep. 5, 2008 designating the U.S., and which claims priority to European Application 07116040.2 filed in Europe on Sep. 10, 2007. The entire contents of these applications are hereby incorporated by reference in their entireties.

FIELD

The disclosure relates to a circuit breaker, such as a high-voltage circuit breaker.

BACKGROUND INFORMATION

A high-voltage circuit breaker known from U.S. Pat. No. 4,499,350 has a main current path which can be disconnected by an interrupter unit. A secondary current path can be routed in parallel with the main current path, in which a switch and a closing resistor are connected in series with one another in this secondary current path. The closing resistor can be connected into the circuit shortly before the closing of the contact arrangement of the interrupter unit such that the current flows through the secondary current path with the closing resistor, shortly before the main current path is closed. In consequence, the closing resistor can be inserted into the circuit under load. A moving interrupter contact of the interrupter unit can be driven by a drive element via levers and angle elements. A driven contact of the switch can likewise driven by the same drive unit. The driven contact of the switch interacts with a likewise moving opposing contact of the switch, which is prestressed in the direction of the contact by means of a spring. When the high-voltage circuit breaker closes, the switch closes before the interrupter unit. After the switch has closed, the interrupter unit closes, as a result of which the secondary current path can be bridged via the main current path.

During opening of the high-voltage circuit breaker, the switch opens before the interrupter unit, as a result of which the current can be interrupted by the interrupter unit. This can be achieved by the driven contact moving at a higher speed than the opposing contact, on which the force of the spring acts.

Known high-voltage circuit breakers include a large number of individual parts to operate the interrupter unit and the switch. In addition, during opening of the high-voltage circuit breaker, the spring for the switch governs the time at which this opens.

Another gas-insulated, encapsulated high-voltage circuit breaker is disclosed in U.S. Pat. No. 2,117,975. This known high-voltage circuit breaker has an interrupter unit. A switch and a closing resistor are arranged in parallel with this interrupter unit, with the switch being connected in series with the closing resistor. A contact of the switch is moved along an axis in order to connect the closing resistor.

The foregoing US Patents are hereby incorporated by reference in their entireties.

SUMMARY

A gas-insulated, metal-encapsulated circuit breaker is disclosed, comprising: an interrupter unit having a movable, driven first interrupter contact for interaction with a second interrupter contact of the circuit breaker; a closing resistor; a switch, connected in series with the closing resistor, for inserting the closing resistor in a circuit when on load, the switch having a movable switching contact; and means for mechanically coupling the switching contact to movement of the first interrupter contact, the switching contact being configured for rotation about a rotation shaft for the inserting of the closing resistor.

BRIEF DESCRIPTION OF THE DRAWINGS

The subject matter of the disclosure will be explained in more detail in the following text with reference to an exemplary embodiment, and the accompanying schematic Figures, wherein.

Figure 1:
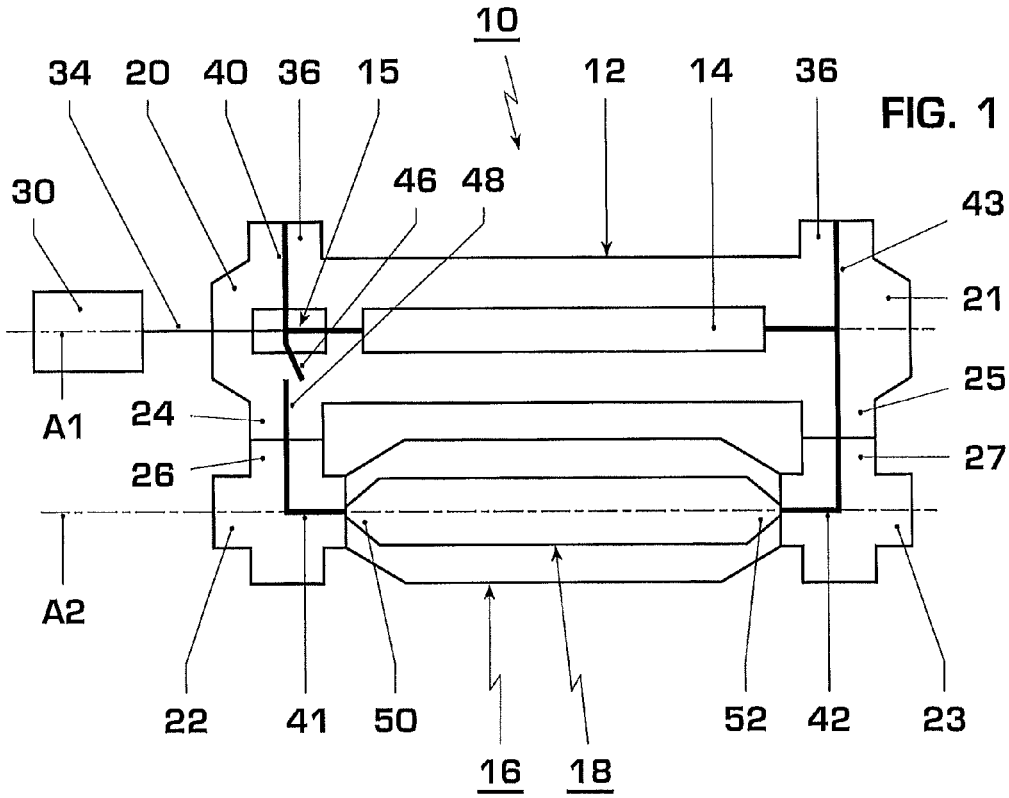
FIG. 1 shows a first exemplary embodiment of a circuit breaker according to the disclosure.

The reference symbols used in the figures and their meanings are listed in summarized form in the list of reference symbols. In principle, identical parts and parts having the same effect are provided with the same or similar reference symbols in the figures. In some cases, parts which are not essential for understanding of the disclosure are not shown. The described exemplary embodiment represents an example of the subject matter according to the disclosure, and has no restrictive effect.

DETAILED DESCRIPTION

An exemplary gas-insulated circuit breaker, such as a high-voltage (e.g., on the order of 1 kV, but without limitation) circuit breaker, is disclosed whose mechanism for opening and closing the interrupter unit and the switch can be simple, and yet operate reliably.

An exemplary circuit breaker has an interrupter unit, a closing resistor and a switch which can be connected in series with the closing resistor. The interrupter unit has a moving, driven first interrupter contact, which can interact with a second interrupter contact in order to open and close the high-voltage circuit breaker. The switch, which can be connected in series with the closing resistor, can have a moving switching contact, whose movement can be mechanically coupled by a coupling means, such as a transmission, to the movement of the first interrupter contact. The switching contact may be designed to move such that the switching contact can rotate about a rotation shaft for insertion of the closing resistor.

According to an exemplary embodiment, the switching contact can be mechanically coupled to the movement which drives this switching contact only during a time period during the closing of the interrupter unit (e.g., only during this time period). This time period can be chosen to be shorter than the duration of the movement for closing the interrupter unit. This type of coupling allows the movement process of the switching contact to be optimally chosen. This allows, for example, virtually any desired control of the times at which the switch closes and opens again during the closing of the interrupter unit.

According to an exemplary embodiment, the transmission can be a link control means formed by a cam transmission. The cam transmission or the link control means allows the switch to be very compact. Furthermore, the cam transmission or the link control means can result in a very small number of elements that move with respect to one another. The switching contact, which moves at a high speed, can be manufactured from a lightweight material. In consequence, the mechanism for driving the switching contact and that for driving the first interrupter contact can be matched to relatively small forces. This allows the overall mechanism to have a lightweight construction overall. In consequence, the drive can be designed to be smaller. The cam transmission or the link control means can allow virtually any desired translation of the linear movement of the first interrupter contact to the rotary movement of the interrupter contact. The cam transmission also can allow virtually any desired control of the times at which the switch closes and opens again during the closing of the interrupter unit.

According to an exemplary embodiment, the main current path which has the interrupter unit can be arranged in parallel with a secondary current path in which the switch and the closing resistor are connected in series with one another. This can allow the closing resistor to be completely disconnected from the circuit after the interrupter unit has closed, as a result of which no $I^2R$ losses occur in the closing resistor.

According to an exemplary embodiment, the rotation shaft of the switching contact can be at right angle to the axis. This allows the high-voltage circuit breaker to be configured in a particularly simple form.

According to an exemplary embodiment, the mechanical coupling means can be arranged in the same gas area as the switch and/or the interrupter unit. This can allow a compact, simple design.

According to an exemplary embodiment, the switch and the interrupter unit can be arranged in a first housing part, and the closing resistor can be arranged in a second housing part. This allows the geometry of the first housing part to be matched to the switch and the interrupter unit. The geometry of the second housing part can likewise be matched to the closing resistor. Overall, this can allow the high-voltage circuit breaker to have a compact design.

According to an exemplary embodiment, the link control means can be configured to include two branches. The first branch can be passed through during closing of the interrupter unit, and the second branch can be passed through during opening of the interrupter unit. This can allow the switch for connection of the closing resistor to be closed only during closure of the interrupter unit. The second branch can be configured such that the switch is not closed during opening of the interrupter unit.

According to an exemplary embodiment the first branch and the second branch can define a cam track which is passed through continuously and is closed. In consequence, the movement of the switching contact can be clearly defined by the link control means.

Figure 2:
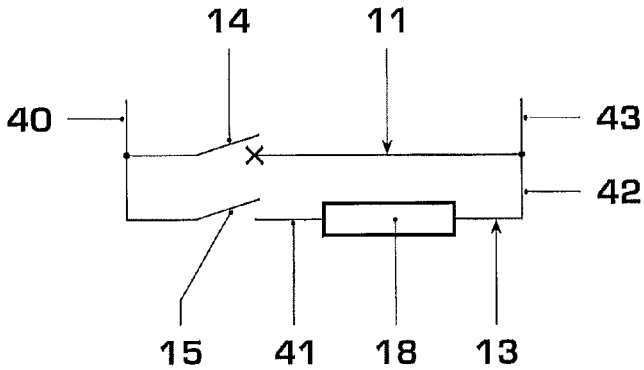
FIG. 2 shows an exemplary circuit diagram of the circuit breaker shown in FIG. 1.

FIG. 1 shows a first exemplary embodiment of a metal-encapsulated, circuit breaker 10 (such as a high-voltage circuit breaker) for a gas-insulated switchgear assembly. FIG. 2 shows an exemplary circuit diagram of the high-voltage circuit breaker of FIG. 1. In exemplary embodiments, sulfur hexafluoride ($SF_6$) can be used as an insulating gas in gas-insulated switchgear assemblies. Any suitable gas with good insulating characteristics can also be used instead of this quenching gas. A secondary current path 13 can be routed in parallel with a main current path 11, which can be interrupted by an interrupter unit 14. This secondary current path 13 can have a switch 15 and a closing resistor 18 in series with one another. Exemplary high-voltage circuit breakers 10 such as these can be used for switching currents in power supply systems at more than 400 kV (kilovolts), and also at more than 500 kV. An exemplary suitable closing resistor is disclosed in U.S. patent application Ser. No. 12/206,769 from the same applicant and entitled "Closing Resistor for High-Voltage Circuit Breakers", the subject matter of which is included by way of reference in its entirety in this patent application.

The exemplary high-voltage circuit breaker 10 can also be used instead of a gas-insulated switchgear assembly in a hybrid switchgear assembly in which elements of the gas-insulated switchgear assembly construction technique are combined with elements of the air-insulated switchgear assembly construction technique. In addition, a plurality of interrupter units can be arranged in series with one another, instead of one interrupter unit.

The exemplary high-voltage circuit breaker 10 has a first housing part 12 in which the switch 15 and interrupter unit 14 can be arranged and, parallel to the first housing part 12, a second housing part 16 in which the closing resistor 18 can be arranged. The first housing part 12 and the second housing part 16 can be manufactured from a metal, such as aluminum, and are at ground potential during operation of the gas-insulated switchgear assembly.

The first housing part 12 and the second housing part 16 can be each provided at both ends with connection end areas 20, 21, 22, 23 which make it possible to couple the first housing part 12 to the second housing part 16. For example, the connection end areas 20, 21, 22, 23 can each have side connection stubs 24, 25, 26, 27 with flanges for this purpose. Between the connection end areas 20, 21, 22, 23, the first housing part 12 and the second housing part 16 can be essentially tubular, or of other desired shape. The interrupter unit 14 may be arranged within the essentially tubular section of the first housing part 12, which defines a first housing axis A1. The closing resistor arrangement 18 can be arranged within the essentially tubular section of the second housing part 16 and can be arranged essentially along a second housing axis A2, which may be defined by the tubular section.

A known drive unit 30 may be coupled to the one connection end area 20 of the first housing part 12. By the drive unit 30, the switch 15 can be driven for connection and disconnection of the closing resistor arrangement 18 and interruption of the secondary current path 13, as well as the interrupter unit 14 for interruption of the main current path 11. The switch 15 may be arranged within that connection end area 20 of the first housing part 12 which is adjacent to the drive unit 30. The mechanical connection between the drive unit 30 and the switch 15, and the interrupter unit 14, may be produced via a drive rod 34 composed of insulating material, which runs in the direction of the first housing axis A1. The drive rod 24 may be moved by the drive unit 30 in the direction of the first housing axis A1. The drive rod 34 can be passed through a gas-tight bushing into the first housing part 12 from the outside.

The two connection end areas 20, 21 of the first housing part 12 can each have an outgoer stub 36, by which the exemplary high-voltage circuit breaker 10 can be connected to further elements of a gas-insulated switchgear assembly. The outgoer stubs 36 may be arranged opposite the connection stubs 24, 25, at the side with respect to the first housing axis A1.

In order to electrically connect the exemplary high-voltage circuit breaker 10 to further elements of the gas-insulated switchgear assembly, a conductor 40 can be run through the outgoer stub 36 of the drive-side connection end area 20 and can be held at a distance from the first housing part 12 by means of any known isolation elements. The conductor 40 can run from the opening in the outgoer connection stub 36 to the switch 15. The conductor 40 can be electrically connected to a moving switching contact 46, which will be described in the following text, of the switch 15 and to a moving first interrupter contact 32 in the interrupter unit 14.

A stationary opposing contact 48 of the switch 15 which will be described below, interacts with the moving switching contact 46 to close the switch 15 and can be arranged within the connection stub of the drive-side connection end area 20 of the first housing part 12. A conductor 41 runs from the opposing contact 48 through the drive-side connection end area 22 of the second housing part 16, and connects the opposing contact 48 to a first connecting contact 50 of the closing resistor 18.

A second connecting contact 52 of the closing resistor 18 can be connected via a further conductor 42. The conductor 42 runs through the connection end area 23 of the second housing part 16, to a conductor 43 which runs from the connection stub 25 of the connection end area 21. The connection end area 21 is remote from the drive 30, of the first housing part 12 to the outgoer stub 36 of the same connection end area 21. A second interrupter contact 33, which is intended for closing the interrupter unit 14, is likewise connected to this conductor 43. The conductors 40, 41, 42, 43 can be held within the first and second housing parts 12, 16, respectively by known insulators in the form of disks or which are conical, such that their distances from the first and second housing parts 12, 16, respectively are, for example, as uniform as possible in the radial direction with respect to the conductors 40, 41, 42, 43.

Figure 3:
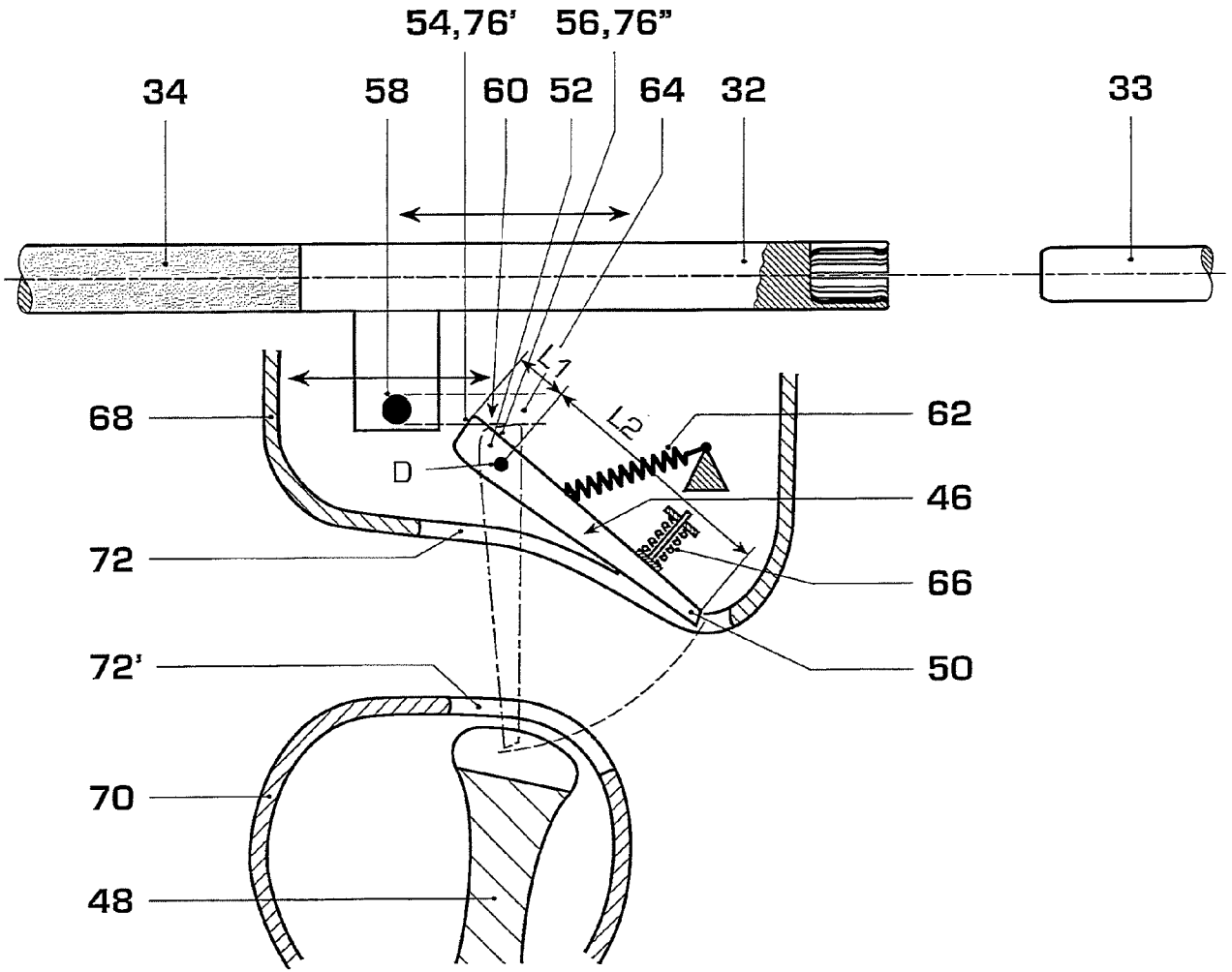
FIG. 3 shows a switch of the first exemplary embodiment, partially in the form of a view and partially sectioned in its open position (solid line), wherein a switching contact is shown in the closed position (dashed line)
Figure 4:
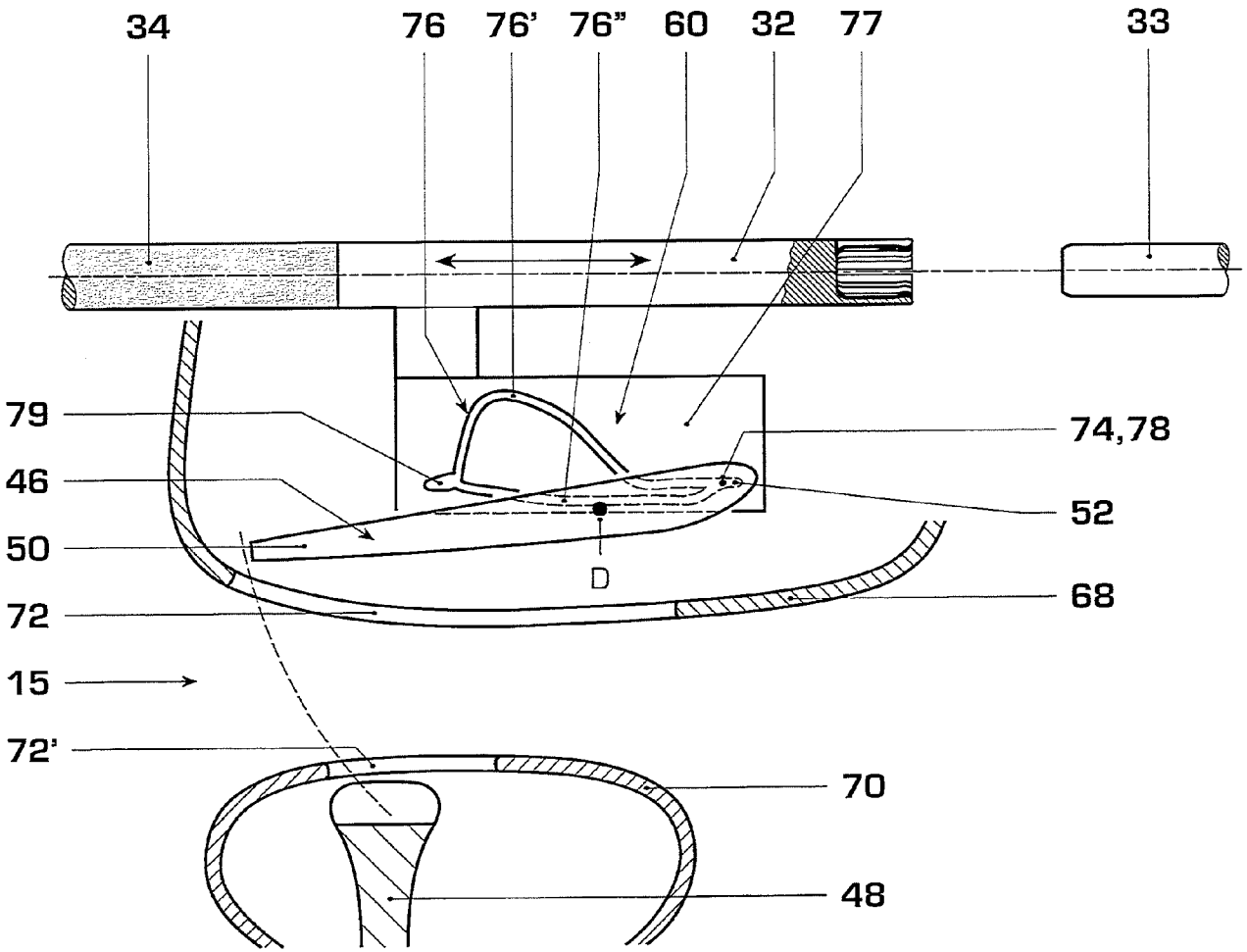
FIG. 4 shows a switch of a second exemplary embodiment of a circuit breaker with an interrupter unit in an open position.
Figure 5:
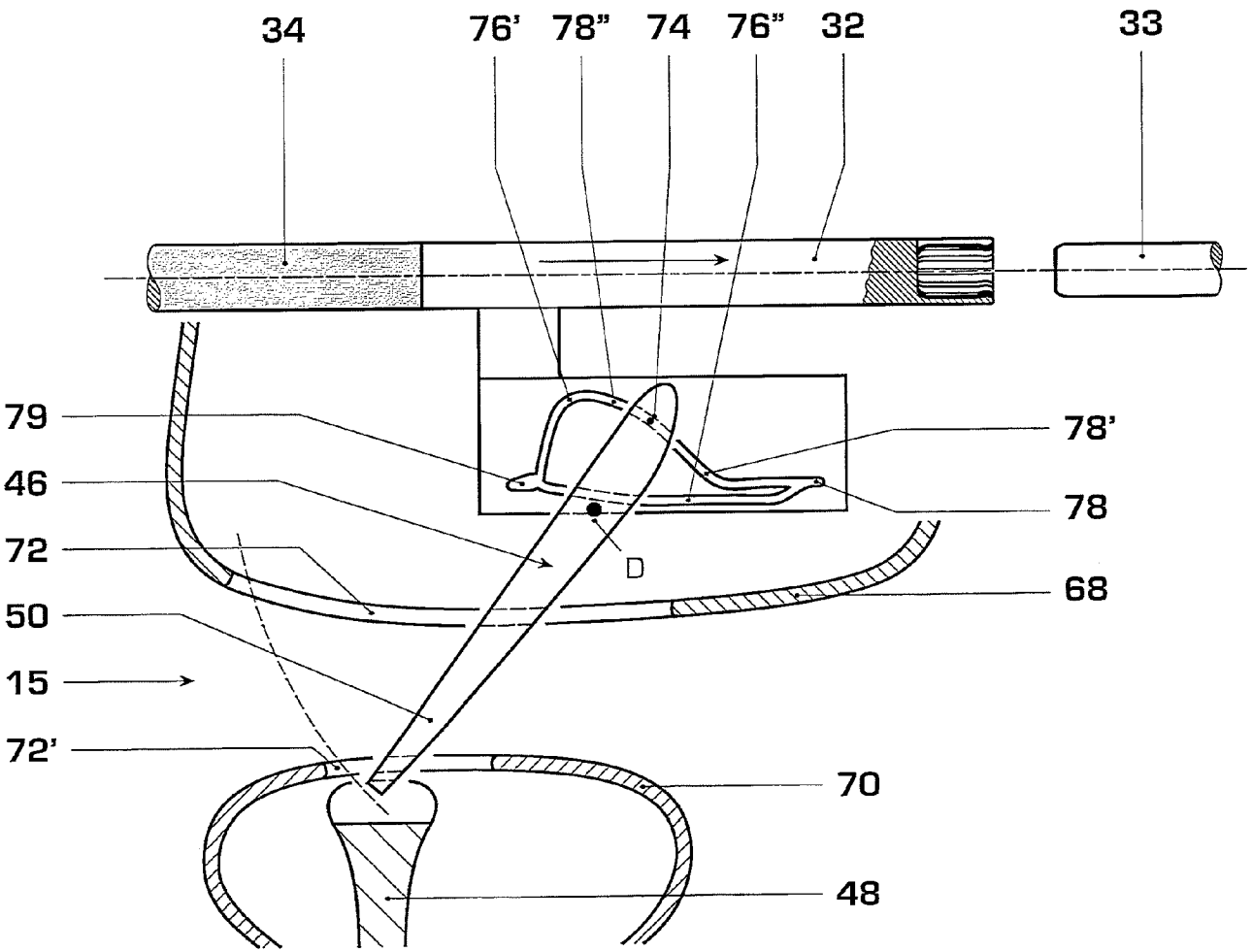
FIG. 5 shows the switch as shown in FIG. 4 at a time during a closing of the interrupter unit.
Figure 6:
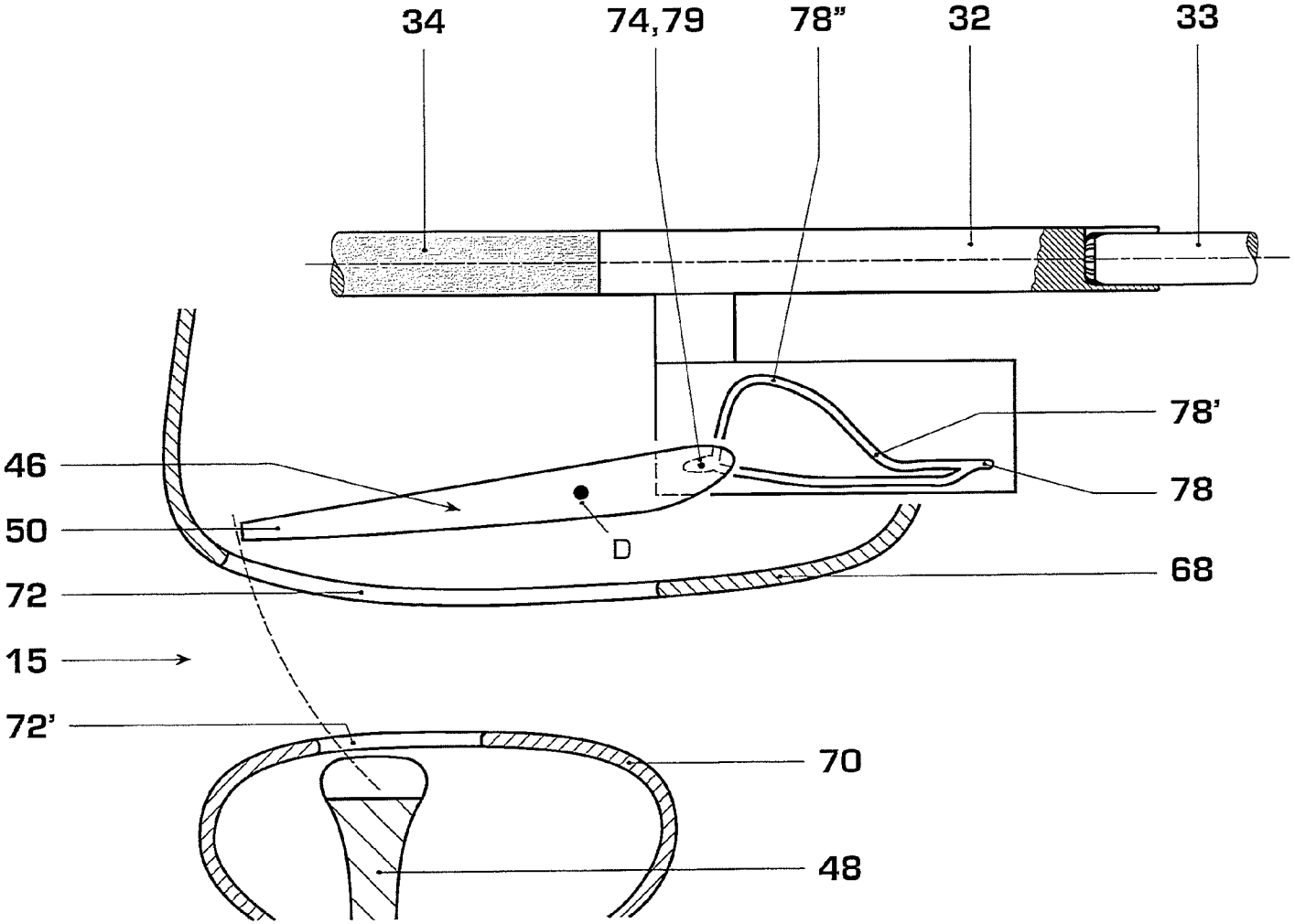
FIG. 6 shows the switch as shown in FIG. 4 with the interrupter unit in a closed position.
Figure 7:
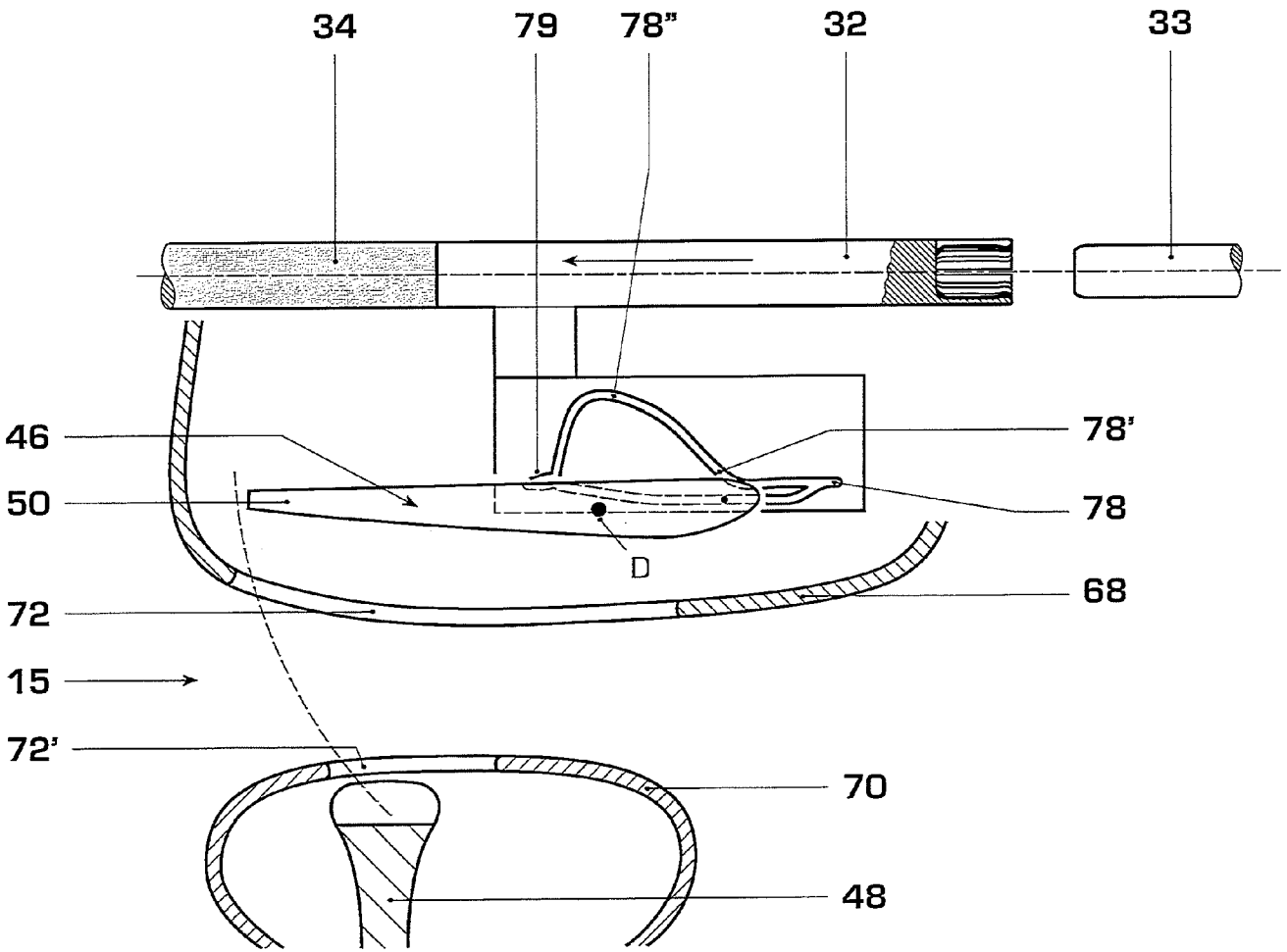
FIG. 7 shows the switch as shown in FIG. 4 during opening of the interrupter unit.

FIG. 3 shows an exemplary switch 15 and parts of the interrupter unit 14 of the first exemplary embodiment in detail.

The first interrupter contact 32, which can move along the first housing axis A1, can be connected directly to the drive rod 34. In order to close the interrupter unit 14, the first interrupter contact 32 interacts with the second interrupter contact 33, which can be arranged on the first housing axis A1. For closure, the first interrupter contact 32 can be pushed on the second interrupter contact 33 in a known manner. In consequence, in order to close the interrupter unit 14 from the open position of the interrupter unit 14 as shown in FIG. 3, the first interrupter contact 32 can be moved via a contact position, in which the first interrupter contact 32 touches the second interrupter contact 33, to the closed position, in which the first interrupter contact 32 has been pushed sufficiently (e.g., completely) onto the second interrupter contact 33. During opening of the interrupter unit 14, the first interrupter contact 32 can be moved in the opposite direction.

The first interrupter contact 32 and the second interrupter contact 33 can each include, for example, a rated current contact and a consumable contact in a known manner. When the interrupter unit 14 is in the open state the first interrupter contact 32 can be separated from the second interrupter contact 33 such that even high voltage spikes, such as those which can occur because of lighting strikes or other disturbances in high-voltage power supply systems, do not lead to an arc being formed between the first interrupter contact 32 and the second interrupter contact 33.

The switch 15 has a switching contact 46 which can be, for example, in a form of a blade that moves about a rotation shaft D, which can be mounted in a fixed position with respect to the housing of the exemplary circuit breaker 10. This switching contact 46 is can interact with the stationary opposing contact 48. The switching contact 46 can be essentially elongated and planar. Its length may be, for example, between 15 cm and 50 cm (or lesser or greater ranges), and in exemplary embodiments between 25 cm and 40 cm. The thickness of the switching contact 46 can be between 0.5 mm and 10 mm (or lesser or greater ranges), and in exemplary embodiments between 2 mm and 4 mm. A lightweight metal, for example, aluminum, is suitable as a material for the switching contact 46.

One end area 50 of the switching contact 46—referred to as the contact-making end area 50—can make contact with the opposing contact 48 in order to close the switch 15. The other end area 52—referred to below as the operating end area 52—can have two guide surfaces 54, 56 which merge into one another and each form one branch 76', 76" of an exemplary link control means 60. The guide surfaces 54, 56 can interact with an actuator 58 for the link control means 60. The actuator 58 can be coupled to the movement of the first interrupter contact 32 of the interrupter unit 14.

In an exemplary embodiment, the actuator 58 can interact with at least a portion of switching contact 46 to form a transmission 60, which is also referred to as a cam transmission. In this case, the actuator 58 can form a first transmission part and at least a portion of the switching contact 46 can be a second transmission part, which interacts with the first transmission part. The choice of the arrangement of the two guide surfaces 54, 56 with respect to the rotation shaft D defines the transmission of the movement from the actuator 58 to the switching contact 46. Because of the guide surfaces 54, 56, which each form a branch 76', 76" of a movement transmission cam, a transmission element also be referred to as a link, and the transmission can be considered as link control means.

The rotation shaft D of the switching contact 46 is arranged between the operating end area 52 and the contact-making end area 50 so as to create a lever ratio of L1:L2 between 1:2 and 1:7 (or other suitable ratios), where L1 denotes the distance from the rotation shaft D to the point of action of the actuator 58 on the operating end area 52, and L2 denotes the distance from the rotation shaft D to the free end of the contact-making end area 50. The lever ratio L1:L2 may be for example 1:2.5 to 1:6 (or other suitable ratios), and in exemplary embodiments 1:2.5 to 1:4. The lever ratio indicates that the contact-making end area 50 can move at a higher speed, governed by, for example, the lever ratio L1:L2, than the operating end area 52.

The rotation shaft D may be located at least approximately at right angles to a plane on which the actuator 58 and opposing contact 48 at least partially lie.

Furthermore, the planar, moving switching contact 46 may likewise moved on this plane.

As will be described in detail in the following text, the switching contact 46 may be moved by means of the actuator 58 by the movement of closing the interrupter unit 14 from the open position shown in FIG. 3 (a solid line in FIG. 3) to the closed position (dashed line in FIG. 3). During this movement, a return spring 62 is stressed, by which the switching contact 46 can be moved back again to the open position at the end of the closing process of the interrupter unit 14. In consequence, the switch 15 closes and opens during the closing movement of the interrupter unit 14.

The actuator 58, which can be firmly coupled to the movement of the first interrupter contact 32, can be moved along the direction of the first housing axis A1. At the start of this movement of the actuator 58, this actuator 58 can come into contact with the first guide surface 54 of the switching contact 46, which can be located in the movement path 64 of the actuator 58, and forms the first branch 76'. During the further movement of the actuator 58, the switching contact 46 can therefore be moved by the actuator 58 away from the open position shown in FIG. 3, in which case—because of the rotary movement of the switching contact 46—the contact point of the actuator 58 on the first guide surface 54 may be first of all moved from the free end area of the operating end area 52 in the direction of the rotation shaft D, and then in the opposite direction, toward the free end of the operating end area 52. As the closing movement of the first interrupter contact 32 progresses further, the actuator 58 breaks contact with the switching contact 46. Even before the actuator 58 breaks contact with the switching contact 46, the interrupter unit 14 passes through the contact position.

Since the actuator 58 is not in contact with the first guide surface 54, the switching contact 46 can be pulled back by a now stressed return spring 62 to the open position, thus opening the switch 15 again.

During opening of the interrupter unit 14, the first interrupter contact 32 can be moved from the closed position to the open position. Since the operating end area 52 can be located in the movement path 64 of the actuator 58, the actuator 58 comes into contact with the second guide surface 56 of the operating end area 52 during the opening of the interrupter unit 14. This forms the second branch 76" of the link control means 60. The actuator 58 forces the operating end area 52 out of the movement path 64 of the actuator 58. As soon as the actuator 58 breaks contact with the operating end area 52, the switching contact 46 can be moved back to the initial position again by the return spring 66, which is stressed during this movement. As an alternative to the return spring 66, if the return spring 62 is of suitable design, the torque caused by the force of gravity can also be applied to the switching contact. For example, the switch 15 can remain open during the process of opening the interrupter unit 14.

As described above, the actuator 58 is not in permanent contact with the first guide surface 56 or the second guide surface 58. In consequence, the switching contact 46 can be mechanically coupled to the movement of the actuator 58 only at times during the closing of the interrupter unit 14. For example, the time period during which the movement of the switching contact 46 is coupled to the movement of the actuator 58 can be shorter than the time period of the closing movement of the interrupter unit 14.

In order, as far as possible, to shield the electrical fields that are produced by the switching contact 46 and the opposing contact 48, and in order to avoid high field strengths resulting from points and edges, thus allowing a compact design, the switching contact 46 and the opposing contact 48 are shielded by a respective shield 68, 70 (not shown in FIG. 1) from the first housing parts (not shown in FIG. 3) and from the opposing contact 48 and the switching contact 46. The shields 68, 70 are electrically connected to the switching contact 46 and, respectively, to the opposing contact 48. Furthermore, the shields 68, 70 can make it possible to reduce the minimum desired separation to cope with high voltage differences between the switching contact 46 and the opposing contact 48. The separation between the shield 68, which surrounds the switching contact 46 in its open position, and the shield 70 which surrounds the opposing contact 48 can be chosen such that the interrupting unit 14 and the switch 15 reliably cope with the same maximum voltage, that is to say such that no arcs are formed even in the event of unexpected voltage spikes.

The shields 68 at the side of the switching contact 46 have a slot 72, such that the switching contact 46, which can be completely surrounded by the shield 68 in the open position, can emerge from this shield 68. The shield 70 likewise has a slot 72' on the side of the opposing contact 48, by which the contact-making end area 50 of the switching contact 46 can pass through this shield 70 and can engage in the opposing contact 48.

An exemplary timing of the movement process of the interrupter unit 14 and switch 15 can be as follows.

While the interrupter unit 14 is closing, the switch 15 closes and opens. The first interrupter contact 32 can move toward the second interrupter contact 33, thus reducing the distance between the first and the second interrupter contacts 32, 33. Before an arc is formed between the interrupter contacts 32, 33, the switching contact 46 can make contact with the opposing contact 48, thus closing the secondary current path 13 between the conductor 40 and the conductor 43 via the switch 15 and the closing resistor 18. Once the first interrupter contact 32 has made contact with the second interrupter contact 33, and the main current path 11 has therefore been closed by the interrupter unit 14, the switch 15 opens. As a result, the secondary current path 13 can be interrupted, and the closing resistor 18 can be removed from the circuit.

The switch 15 is not closed during the opening of the interrupter unit 14.

FIGS. 4-7 show the switch 15 for a second exemplary embodiment of a circuit breaker, such as a high-voltage circuit breaker. Except for the switch 15, the second exemplary embodiment is designed in the same way as the first exemplary embodiment. Those parts of the interrupter unit 14 which are shown in FIGS. 4-7 can likewise be designed in the same way as in the first exemplary embodiment.

The switch 15 once again has the blade-type switching contact 46 which can move about the rotation shaft D. On the operating end area 52, the switching contact 46 can have a mandrel 74 which engages in a cam track 76 in a link disk 77. The cam track 76 is formed by a groove. The interaction of the mandrel 74 with the cam track 76 forms the link control means 60.

The rotation shaft D around which the switching contact 56 can rotate once again defines the two levers L1, L2 on the switching contact 46, with one lever L1 being defined by the mandrel 74 and the rotation shaft D, and with the other lever L2 being defined by the contact-making end area 50 and the rotation shaft D.

As an alternative to the embodiment of the switching contact as shown in the figures, the rotation shaft can also be arranged on that end area of the switching contact which is opposite to the contact-making end area, with the mandrel being arranged between the rotation shaft and the contact-making end area.

The link disk 77 can be firmly coupled to the movement of the first interrupter contact 32. The link disk 77 has the cam track 76, which has a first branch 76' and a second branch 76", with the two branches 76', 76" being contiguous. The two end areas of each branch 76', 76" mergeing into the other branch 76", 76'. The first branch 76' defines the movement of the switching contact 46 during closure of the interrupter unit 14, and the second branch 76" defines the movement of the switching contact 46 during opening of the interrupter unit 14. The timing of the movement process of the interrupter unit 14 and of the switch 15 can be essentially analogous to the movement process described in conjunction with this first exemplary embodiment. However, the second exemplary embodiment can allow the movement process of the switching contact 46 to be better matched to the movement of the first interrupter contact 32.

The first branch 76' runs from a point 78 (see for example FIGS. 5-7) which defines a state of the link control means in which the interrupter unit 14 and the switch 15 are open, to a point 78'. Between the point 78 and the point 78', the first branch 76' runs essentially parallel to the movement direction of the first interrupter contact 32, or slightly away from the opposing contact 48. The switching contact 46 does not move significantly while passing through this section, at the start of the closing movement of the first interrupter contact 32, and in consequence is not coupled to the movement of the first interrupter contact 32. At the point 78', the first branch 76' then runs away from the opposing contact 48. As a result, this section transmits the movement of the first interrupter contact 32 to the switching contact 46. When passing through the point 78", the switch 15 is closed. The switching contact 46 makes contact with the opposing contact 48. In the vicinity of the point 78", the first branch 76' can be shaped such that the switch 15 remains in its closed position during a time period during which the interrupter unit 14 passes through the contact position. The further course of the first branch 76' defines the opening of the switch 15. For example, the first branch 76' between the point 78" and the point 79 can be shaped such that the switch 15 is opened quickly when passing through this branch section.

The second branch 76" between the point 79 and the point 78 runs essentially parallel to the movement line of the first interrupter contact 32. As a result the switch 15 remains open during the opening of the interrupter unit 14 (see FIG. 7). In consequence, the switching contact 46 is at least not significantly coupled to the movement of the first interrupter contact 32. In the areas in which the two branches 76', 76" run together (in the area of the point 78 and of the point 79), the cam track 76 is shaped such that, because of the inertia of the switching contact 46, the first branch 76' is passed through during the closure of the interrupter unit 14, and the branch 76" is passed through during the opening of the interrupter unit 14.

During the closure of the switch 15, the switching contact 46 can cover an angle range between 30° and 80°, (or angles lesser or greater than these) in exemplary embodiments between 35° and 70°, and for example, between 45° and 60°. This can make it possible to ensure that the contact-making end area 50 moves approximately on a straight line, to minimize the risk of an arc being formed. This can also simplifies the desire for shielding and for the geometry of the connection end area 20 of the first housing part 12.

In a similar manner to that in the case of the first exemplary embodiment, a transmission 60 can be formed as a link control means which can include the link disk 77 with the cam track 76 and by the switching contact 46, which interacts with the link disk 77. This can also be referred to as a cam transmission. In this case, the link disk 77 forms the first transmission part, and the switching contact 46 (and/or portions thereof) forms the second transmission part, which interacts with the first transmission part. The second transmission part can be mechanically coupled to the first transmission part by the mandrel 74, which is formed on the switching contact 46, engaging in the cam track 76 which is formed on the link disk 77. The choice of the arrangement of the two branches 76', 76" of the cam track 76 can define the transmission of the movement of the cam disk 77 to the switching contact 46.

The switching contact 46 and the opposing contact 48 may be provided with a respective shield 68, 70, analogously to the first exemplary embodiment.

Figure 8:
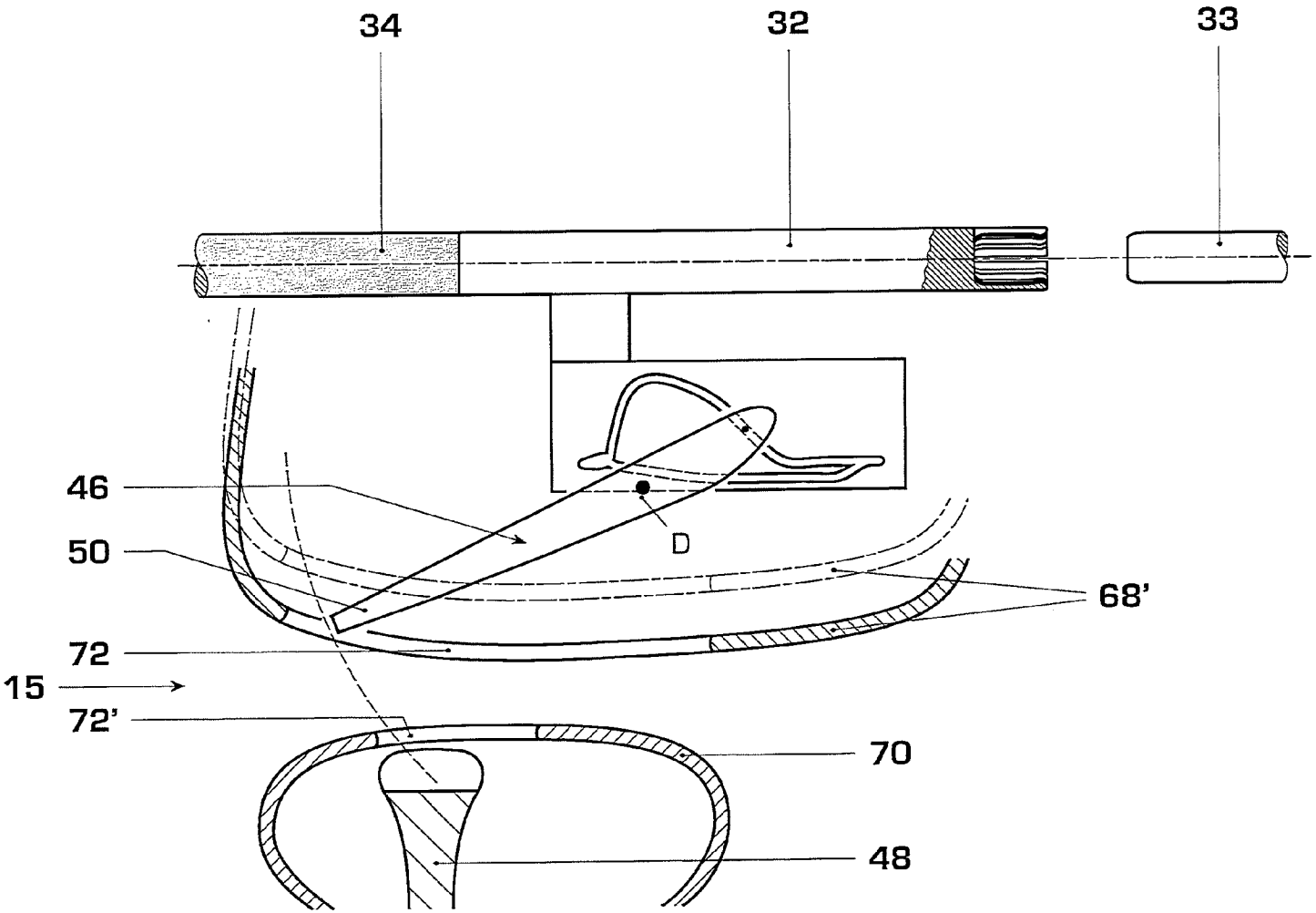
FIG. 8 shows a switch of a third exemplary embodiment of a circuit breaker, in which a shield for shielding a switching contact is designed such that it can move.

A third exemplary embodiment, which is illustrated in FIG. 8, is similar to the second exemplary embodiment. Instead of the fixed shield 68 for shielding the switching contact 46, this shield 68' in this third exemplary embodiment can be configured such that it can move.

The moving shield 68' can either be coupled directly to the movement of the first interrupter contact 32, directly to the movement of the switching contact 46, or by a further link control means, to the movement of the first interrupter contact 32. For example, a direct coupling can be provided via a lever joint. The further link control means can be configured essentially analogously to the link control means 60 described above, in which case the cam track for the further link control means can be chosen such that the cam track defines the movement process of the moving shield as described below.

During the closing movement of the interrupter unit 14, the moving shield 68' of the switching contact 46 can be moved from an initial position (shown by dashed lines in FIG. 8) toward the opposing contact 48. In this example, initially, the contact-making end area 50 of the switching contact 46 remains within the shield 68' during the movement in the direction of the opposing contact 48 (see FIG. 8, represented by a solid line). As soon as a minimum distance between the moving shield 68' and the shield 70 of the opposing contact 48 is reached, the movement of the moving shield 68' is stopped. The contact-making end area 50 emerges from the moving shield 68' through the slot 72, and then makes contact with the opposing contact 48. The minimum distance can be defined such that no arc is created between the shields 68', 70 in normal conditions (that is to say when there are no unpredicted voltage spikes). After contact has been made, the switch 15 is opened again, and this procedure takes place analogously to the second exemplary embodiment. During the opening of the switch 15, the moving shield 68' is once again moved back to its initial position.

During opening of the interrupter unit 14, the moving shield 68' can remain in its initial position or can be once again moved to the position at a minimum distance from the shield 70.

The moving shield can make it possible to shorten the burning duration of any arc which is struck between the switching contact 46 and the shield 70 of the opposing contact 48, in comparison to the second exemplary embodiment.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 High-voltage circuit breaker
11 Main current path
12 First housing part
13 Secondary current path
14 Interrupter unit
15 Switch
16 Second housing part

18 Closing resistor
20-23 Connection end areas
24-27 Connection stub
30 Drive unit
32 First interrupter contact
33 Second interrupter contact
34 Drive rod
36 Outgoer stub
40-43 Conductors
46 Switching contact
48 Opposing contact
50 Contact-making end area
52 Operating end area
54 First guide surface
56 Second guide surface
58 Actuator
60 Transmission, link control means
62 Return spring
64 Movement path
66 Return spring
68 Shield of 46
70 Shield of 48
68' Moving shield of 46
72, 72' Slot
74 Mandrel
76 Cam track
76' First branch
76" Second branch
77 Link disk
78, 78', 78", 79 Points
A1 First housing axis
A2 Second housing axis
D Rotation shaft

What is claimed is:

1. A gas-insulated, metal-encapsulated circuit breaker comprising:

an interrupter unit having a movable, driven first interrupter contact for interaction with a second interrupter contact of the circuit breaker;

a closing resistor;

a switch, connected in series with the closing resistor, for inserting the closing resistor in a circuit when the circuit is under load, the switch having a movable switching contact; means for mechanically coupling the switching contact to movement of the first interrupter contact, the switching contact being configured for rotation about a rotation shaft for the inserting of the closing resistor; and a first fixed axis for movement of the first interrupter contact, the second interrupter contact being arranged on the first axis, wherein the means for mechanically coupling converts linear movement in a direction of the first axis, of at least one of a drive rod of the switch and of the first interrupter contact, to a rotary movement about the rotation shaft.

2. The circuit breaker as claimed in claim 1, wherein the rotation shaft is mounted in a fixed position.

3. The circuit breaker as claimed in claim 1, wherein the switching contact is mechanically coupled for movement during a time period during of closing the interrupter unit, wherein the time period is shorter than a duration of the movement for closing the interrupter unit.

4. The circuit breaker as claimed in claim 1, wherein the means for mechanically coupling comprises:

a cam transmission.

5. The circuit breaker as claimed in claim 1, wherein the switch is configured to remain open during opening of the interrupter unit.

6. The circuit breaker as claimed in claim 1, comprising:

a main current path, the interrupter unit being configured to interrupt the main current path; and a secondary current path in parallel with the main current path, and including the switch and the closing resistor.

7. The circuit breaker as claimed claim 1, wherein the rotation shaft is at a right angle to the axis.

8. The circuit breaker as claimed claim 1, wherein the means for mechanically coupling is arranged in a gas area of at least one of the switch and the interrupter unit.

9. The circuit breaker as claimed in claim 1, comprising:

a lever ratio of a first lever to a second lever of the switching contact of between 1:2 and 1:7, wherein the first lever is defined by a point of action of the means for mechanically coupling on the switching contact and the rotation shaft, and the second lever is defined by a contact-making end area of the switching contact and the rotation shaft.

10. The circuit breaker as claimed in claim 1, comprising:

a first housing in which the switch and the interrupter unit are arranged; and a second housing part in which the closing resistor is arranged, the first axis being a housing axis of the first housing part.

11. The circuit breaker as claimed in claim 4, wherein the means for mechanically coupling comprises:

two branches, the first branch being configured to be passed through during closing of the interrupter unit, and the second branch being configured to be passed through during opening of the interrupter unit.

12. The circuit breaker as claimed in claim 11, wherein the first branch and the second branch define a cam track which is configured to be passed through continuously and is closed.

13. The circuit breaker as claimed in 12, wherein the cam track is restricted on both sides.

14. The circuit breaker as claimed in claim 11, wherein the first branch and the second branch each comprise:

a first end area and a second end area, wherein the first end area of the first branch merges into the first end area of the second branch, and the second end area of the first branch is at a distance from the second end area of the second branch.

15. The circuit breaker as claimed in claim 1, comprising:

an opposing contact for interaction with the switching contact to close the switch, wherein the switching contact and the opposing contact are each shielded by a shield when the switch is in an open position.

16. The circuit breaker as claimed in claim 15, wherein the shield which shields the switching contact is movable and directly coupled to the movement of at least one of the interrupter contact and the switching contact.

17. The circuit breaker as claimed in claim 1, comprising:

a lever ratio of a first lever to a second lever of the switching contact of between 1:2.5 and 1:6, wherein the first lever is defined by a point of action of the means for mechanically coupling on the switching contact and the rotation shaft, and the second lever is defined by a contact-making end area and the rotation shaft.

18. The circuit breaker as claimed in claim 1, comprising:

a lever ratio of a first lever to a second lever of the switching contact of between 1:1.25 and 1:4, wherein the first lever is defined by a point of action of the means for mechanically coupling on the switching contact and the rotation shaft, and the second lever is defined by a contact-making end area and the rotation shaft.

19. The circuit breaker as claimed in claim 15, wherein the means for mechanically coupling comprises:

a means for link control.

20. The circuit breaker as claimed claim 15, wherein the shield which shields the switching contact is moveable and is coupled via a link control means to the movement of the interrupter contact.

21. The circuit breaker of claim 1, configured as a high-voltage circuit breaker for interrupting a voltage of at least 400 kV.

22. The circuit breaker as claimed in claim 1, wherein the switching contact has a thickness between 0.5 mm and 10 mm.

23. The circuit breaker as claimed in claim 1, wherein the switching contact is a made of a lightweight metal such as aluminum.

24. The circuit breaker as claimed in claim 15, comprising an opposing contact for interaction with the switching contact to close the switch, wherein the switching contact is connected to a return spring that can be stressed during closing of the switch such that the switching contact can be moved to an open position after the closing.

25. The circuit breaker as claimed in claim 24, comprising a second return spring for preventing the switching contact from moving back towards the opposing contact when the switching contact is in the open position.

26. An encapsulated circuit breaker comprising:

a movable, driven first interrupter contact for interaction with a second interrupter contact of the circuit breaker in a main current path of the circuit breaker;

a closing resistor;

a switch, connected in series with the closing resistor, for inserting the closing resistor in a secondary current path of the circuit breaker which is parallel to the main current path, the switch having a movable switching contact;

means for mechanically coupling the switching contact to movement of the first interrupter contact, the switching contact being configured for rotation about a rotation shaft for the inserting of the closing resistor; and a first fixed axis for movement of the first interrupter contact, the second interrupter contact being arranged on the first axis, wherein the means for mechanically coupling converts linear movement in a direction of the first axis, of at least one of a drive rod of the switch and of the first interrupter contact, to a rotary movement about the rotation shaft.

* * * * *